US009163365B2

(12) United States Patent
Solis

(10) Patent No.: US 9,163,365 B2
(45) Date of Patent: Oct. 20, 2015

(54) ANTI-ICING SYSTEM

(71) Applicant: Bertram Solis, Akron, OH (US)

(72) Inventor: Bertram Solis, Akron, OH (US)

( * ) Notice: Subject to any disclaimer, the term of this patent is extended or adjusted under 35 U.S.C. 154(b) by 0 days.

(21) Appl. No.: 14/384,966

(22) PCT Filed: Mar. 13, 2013

(86) PCT No.: PCT/US2013/030702

§ 371 (c)(1),
(2) Date: Sep. 12, 2014

(87) PCT Pub. No.: WO2013/138420

PCT Pub. Date: Sep. 19, 2013

(65) Prior Publication Data

US 2015/0013246 A1 Jan. 15, 2015

Related U.S. Application Data

(60) Provisional application No. 61/685,273, filed on Mar. 14, 2012.

(51) Int. Cl.

| | |
|---|---|
| ***E04F 11/16*** | (2006.01) |
| ***E01C 11/22*** | (2006.01) |
| ***E04F 11/17*** | (2006.01) |
| ***E01C 11/24*** | (2006.01) |

(52) U.S. Cl.
CPC ..... *E01C 11/229* (2013.01); *E01C 11/245* (2013.01); *E04F 11/17* (2013.01)

(58) Field of Classification Search
CPC . A47G 27/0287; A61M 1/008; E01C 11/265; E01C 11/229
USPC ..... 52/177, 179, 181
See application file for complete search history.

(56) References Cited

U.S. PATENT DOCUMENTS

| | | | | |
|---|---|---|---|---|
| 2,745,942 | A * | 5/1956 | Cohen | 219/528 |
| 5,854,470 | A * | 12/1998 | Silva | 219/528 |
| 6,202,689 | B1 * | 3/2001 | Williams | 137/602 |
| 7,316,834 | B2 * | 1/2008 | Hernandez | 428/60 |
| 8,076,619 | B1 * | 12/2011 | Wingale | 219/528 |
| 8,277,741 | B2 * | 10/2012 | McCabe | 422/186.3 |
| 8,409,688 | B2 | 4/2013 | Afolabi | |
| 8,533,901 | B2 * | 9/2013 | Williams | 15/311 |

(Continued)

FOREIGN PATENT DOCUMENTS

| | | |
|---|---|---|
| JP | 05-031192 | 4/1993 |
| JP | 09-088004 A | 3/1997 |

(Continued)

OTHER PUBLICATIONS

PCT International Preliminary Report on Patentability, International Application No. PCT/US2013/030702, Sep. 16, 2014.
PCT International Search Report, International Application No. PCT/US2013/030702, Jun. 17, 2013.
PCT Written Opinion of the International Search Authority, International Application No. PCT/US2013/030702, Jun. 17, 2013.

*Primary Examiner* — Basil Katcheves
(74) *Attorney, Agent, or Firm* — Timothy D. Bennett; Emerson Thomson Bennett

(57) ABSTRACT

An anti-icing system may maintain a thin layer of solution on top of pedestrian reception areas to prevent frozen precipitation from remaining frozen on the pedestrian reception areas. This greatly reduces the slippery surfaces that pedestrians would otherwise encounter when using the walk-on surface.

20 Claims, 9 Drawing Sheets

(56) References Cited

U.S. PATENT DOCUMENTS

2008/0104782 A1* 5/2008 Hughes ..... 15/30
2008/0310996 A1* 12/2008 Kim et al. ..... 422/24

FOREIGN PATENT DOCUMENTS

JP 2003-313841 A 11/2003
KR 20-0248485 10/2001

* cited by examiner

ANTI-ICING SYSTEM

I. BACKGROUND

A. Field of Invention

This invention generally relates to the treatment of walk-on surfaces due to snow and ice and more specifically relates methods and apparatuses to continuously remove snow and ice from walk-on surfaces.

B. Description of the Related Art

A well-known problem in regions where the temperature drops below the freezing temperature of water, is that snow and ice collect on surfaces that pedestrians walk on, such as sidewalks, stair steps, etc., ("walk-on" surfaces). This makes such walk-on surfaces dangerous as pedestrians are more likely to slip and fall on them when they are covered with snow/ice. There are several known ways to treat this problem but they can be categorized into two general types: removal methods and preventative methods.

Removal methods include the use of shovels, brooms, and the like to remove the snow/ice from the walk-on surfaces. Another known removal method is the use of a mat that is placed onto a walk-on surface prior to the precipitation that causes the snow/ice. Then after the snow/ice collects on the mat, a person can lift the mat off of the walk-on surface and "break off" the snow/ice. The mat can then be replaced on the walk-on surface.

Preventative methods include the use of an anti-icing agent, such as salt, that is spread onto the walk-on surfaces (either prior to the precipitation or after). The salt serves to decrease the melting temperature of the snow/ice so that the snow/ice melts into water on the walk-on surfaces. The melted snow/ice then easily flows off of the walk-on surfaces. Another known preventative method is the use of an electrically heated mat. The heated mat is placed onto a walk-on surface prior to the precipitation that causes the snow/ice. Because the mat is heated, the snow/ice melts into water which then flows off.

Many of the known methods of treating walk-on surfaces for snow/ice work well for their intended purposes. They also have disadvantages, however. Removal methods require physical exertion by the persons when removing the snow/ice. In cases where the snow/ice is deep, removal methods may be dangerous as it is well known for persons to injure themselves (especially their backs) while removing snow/ice. Another disadvantage of removal methods is that they must be repeated every time additional snow/ice accumulates on the walk-on surfaces. The preventative method of spreading salt also has the disadvantage of needing to be repeated every time additional snow/ice accumulates. The preventative method of a heated mat has the disadvantage of requiring an electric power source which increases the cost and has the capability of being dangerous given the electric conductivity of water/snow/ice.

What is needed is an anti-icing system that overcomes or reduces the disadvantages of known treatments of walk-on surfaces.

II. SUMMARY

According to one embodiment of this invention, An anti-icing system for use by an associated typically sized human pedestrian having a weight and a foot with: (1) an associated walk-on surface that is an outdoor step positioned at least 4 inches above a neighboring ground surface and having a length and a tread depth; and, (2) an associated anti-icing agent may include: a tray comprising: a bottom suitable to be positioned on the associated walk-on surface; and, a top that faces an associated source of frozen precipitation when the tray is positioned on the associated walk-on surface; and, a storage container having a cavity. The top of the tray may comprise: (1) an outer wall that forms a perimeter of a pool area and that has an overflow drain formed on an upper portion of the outer wall; wherein the outer wall has a minimum height H1 with respect to the bottom of the tray defined at the overflow drain; wherein the pool area has a length substantially equal to the length of the outdoor step and a width substantially equal to the tread depth of the outdoor step; (2) a first platform positioned within the pool area and having an upper surface defining a pedestrian reception area strong enough to support the weight of the associated pedestrian via the foot to the associated walk-on surface; wherein the first platform has a maximum height H2 with respect to the bottom of the tray that is less than height H1; (3) a second platform positioned within the pool area and having an upper surface defining a pedestrian reception area strong enough to support the weight of the associated pedestrian via the foot to the associated walk-on surface; wherein the second platform has a maximum height H3 with respect to the bottom of the tray that is less than height H1; and, (4) a first channel that separates the first and second platforms and that has a first side defined by the first platform, a second side defined by the second platform, and a bottom; wherein the bottom of the first channel has a minimum height with respect to the bottom of the tray that is less than height H2. The storage container may be positioned to communicate the cavity with the pool area. The anti-icing system may operate when the associated anti-icing agent is placed within the cavity and associated frozen precipitation enters the pool area to draw the anti-icing agent out of the storage container and into the pool area to melt the associated frozen precipitation to form a solution that continuously covers the pedestrian reception areas of the first and second platforms and that drains out of the pool area through the overflow drain as the associated frozen precipitation continues to enter the pool area.

According to another embodiment of this invention, an anti-icing system for use with an associated walk-on surface and an associated anti-icing agent by an associated typically sized human pedestrian having a weight and a foot, may include: a tray comprising: a bottom suitable to be positioned on the associated walk-on surface; and, a top that faces an associated source of frozen precipitation when the tray is positioned on the associated walk-on surface; and, a storage container having a cavity. The top of the tray may comprise: (1) an outer wall that forms a perimeter of a pool area and that has an overflow drain formed on an upper portion of the outer wall; wherein the outer wall has a minimum height H1 with respect to the bottom of the tray defined at the overflow drain; and, (2) a first platform positioned within the pool area and having an upper surface defining a pedestrian reception area strong enough to support the weight of the associated pedestrian via the foot to the associated walk-on surface; wherein the first platform has a maximum height H2 with respect to the bottom of the tray that is less than height H1. The storage container may be positioned to communicate the cavity with the pool area. The anti-icing system may operate when the associated anti-icing agent is placed within the cavity and associated frozen precipitation enters the pool area to draw the anti-icing agent out of the storage container and into the pool area to melt the associated frozen precipitation to form a solution that continuously covers the pedestrian reception area of the first platform and that drains out of the pool area through the overflow drain as the associated frozen precipitation continues to enter the pool area.

According to yet another embodiment of this invention, a method for use with an associated walk-on surface by an associated typically sized human pedestrian having a weight and a foot, may include the steps of: (A) providing an anti-icing system comprising: a tray comprising: (1) a bottom; and, a top; and, (2) a storage container having a cavity; (B) providing the top of the tray with: (1) an outer wall that forms a perimeter of a pool area and that has an overflow drain formed on an upper portion of the outer wall; wherein the outer wall has a minimum height H1 with respect to the bottom of the tray defined at the overflow drain; and, (2) a first platform positioned within the pool area and having an upper surface defining a pedestrian reception area strong enough to support the weight of the associated pedestrian via the foot to the associated walk-on surface; wherein the first platform has a maximum height H2 with respect to the bottom of the tray that is less than height H1; (C) positioning the bottom of the tray onto the associated walk-on surface with the top facing an associated source of frozen precipitation; (D) positioning the storage container with respect to the tray so that the cavity communicates with the pool area; (E) placing an anti-icing agent within the cavity; (F) allowing frozen precipitation to enter the pool area; (G) drawing the anti-icing agent out of the storage container and into the pool area to melt the frozen precipitation to form a solution that continuously covers the pedestrian reception area of the first platform; and, (H) draining excess amounts of the solution out of the pool area through the overflow drain as the associated frozen precipitation continues to enter the pool area.

Numerous benefits and advantages of this invention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
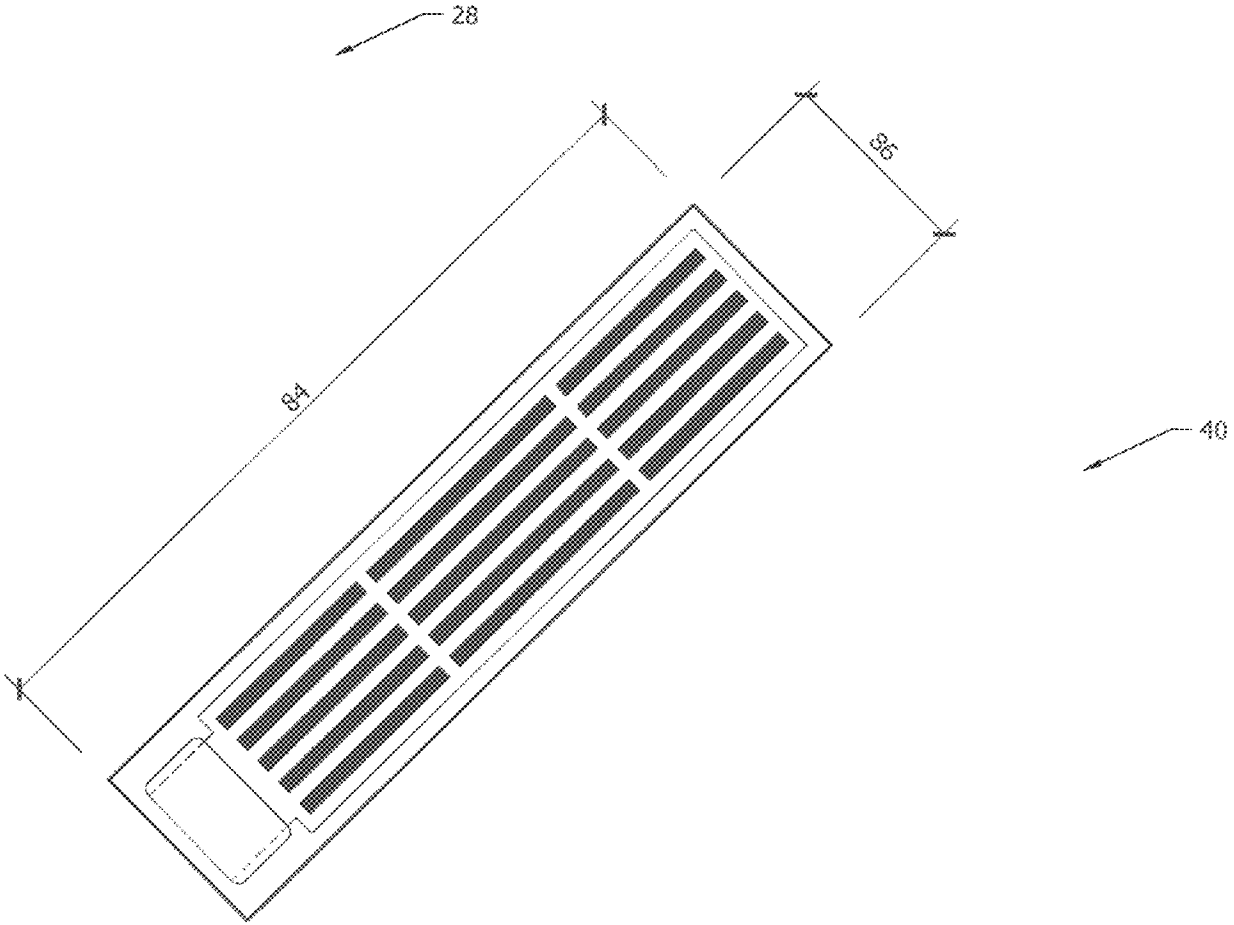
FIG. 1 is a perspective top view of a set of steps where one step is equipped with an anti-icing system according to some embodiments of this invention.
Figure 2:
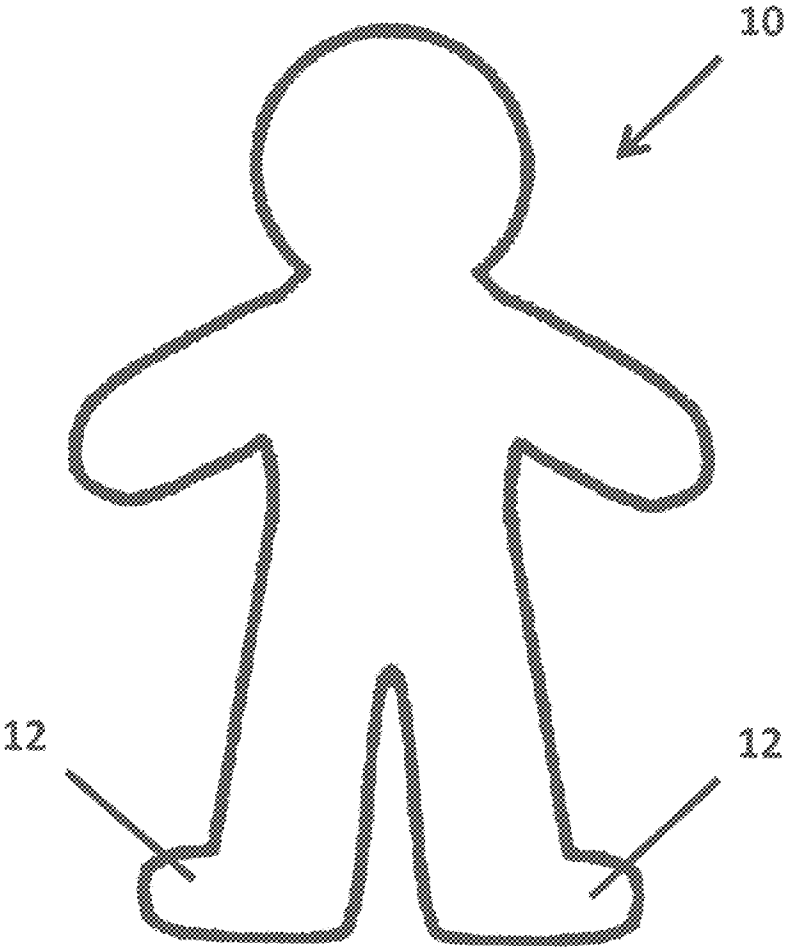
FIG. 2 is a generic representation of a pedestrian.
Figure 3:
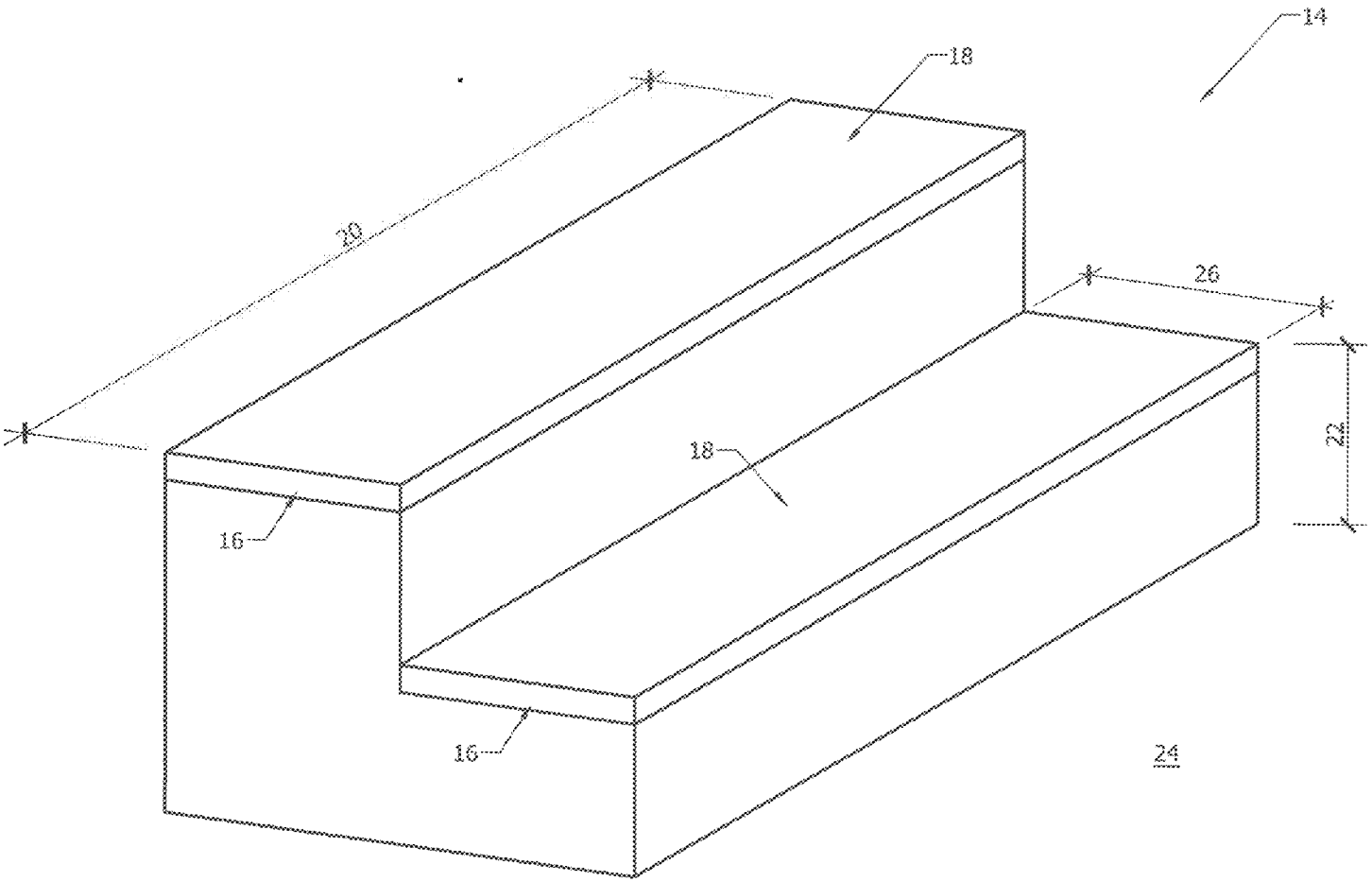
FIG. 3 is a perspective view of a set of steps.

Referring now to the drawings wherein the showings are for purposes of illustrating embodiments of the invention only and not for purposes of limiting the same, and wherein like reference numerals are understood to refer to like components, FIG. 1 shows an anti-icing system 40 according to some embodiments of this invention. The anti-icing system 40 is designed to be positioned on a walk-on surface and used by pedestrians. By "pedestrian" it is meant, as shown in FIG. 2, a human 10 who is typically sized and who has feet 12 that the human uses to walk from place to place in a known manner. By a "walk-on" surface it is meant a surface that pedestrians walk on. Non-limiting examples of a walk-on surface include sidewalks, stair steps and the like. Typically walk-on surfaces lie substantially on a horizontal plane. For some embodiments of this invention, the anti-icing system 40 is positioned on a walk-on surface that is an outdoor step, such as shown in FIG. 1. FIG. 3 shows a typical non-limiting set of steps 14 that could be used with this invention. The set of steps 14 may include at least one step 16, two shown, that has a walk-on surface 18 used by pedestrians in a known manner. As is known by those of skill in the art, each step 16 may have a length 20, a vertical height 22, known as the riser, above a neighboring ground surface 24, and a width 26, known as the tread depth. The anti-icing system 40 shown in FIG. 1 is positioned on the bottom step of a set of steps 28, but it should be understood that it could be placed on any of the steps and that an anti-icing system 40 could be placed on each step.

With reference now to FIGS. 4-8 and 10, various embodiments of anti-icing systems will be described. The embodiments shown are: anti-icing system 40, shown in FIGS. 1 and 4; anti-icing system 50, shown in FIG. 5; anti-icing system 52, shown in FIG. 6; anti-icing system 60, shown in FIGS. 7-8; anti-icing system 62 shown in the top portion of FIG. 10; and anti-icing system 64 shown in the bottom portion of FIG. 10. Because many of the components are similar to more than one embodiment, though the size, shape and number may vary, the same reference numbers will be used. Each anti-icing system may include a tray 70 and a storage container 72. The tray 70 may have a bottom 74, labeled in FIG. 7, suitable to be positioned on the walk-on surface 18 and a top 76, also labeled in FIG. 7. When the tray 70 is positioned on the walk-on surface 18, the top 76 faces the source of frozen precipitation (freezing rain, snow, sleet, hail, any moisture that later is exposed to freezing temperatures, etc.), generally upward.

Figure 5:
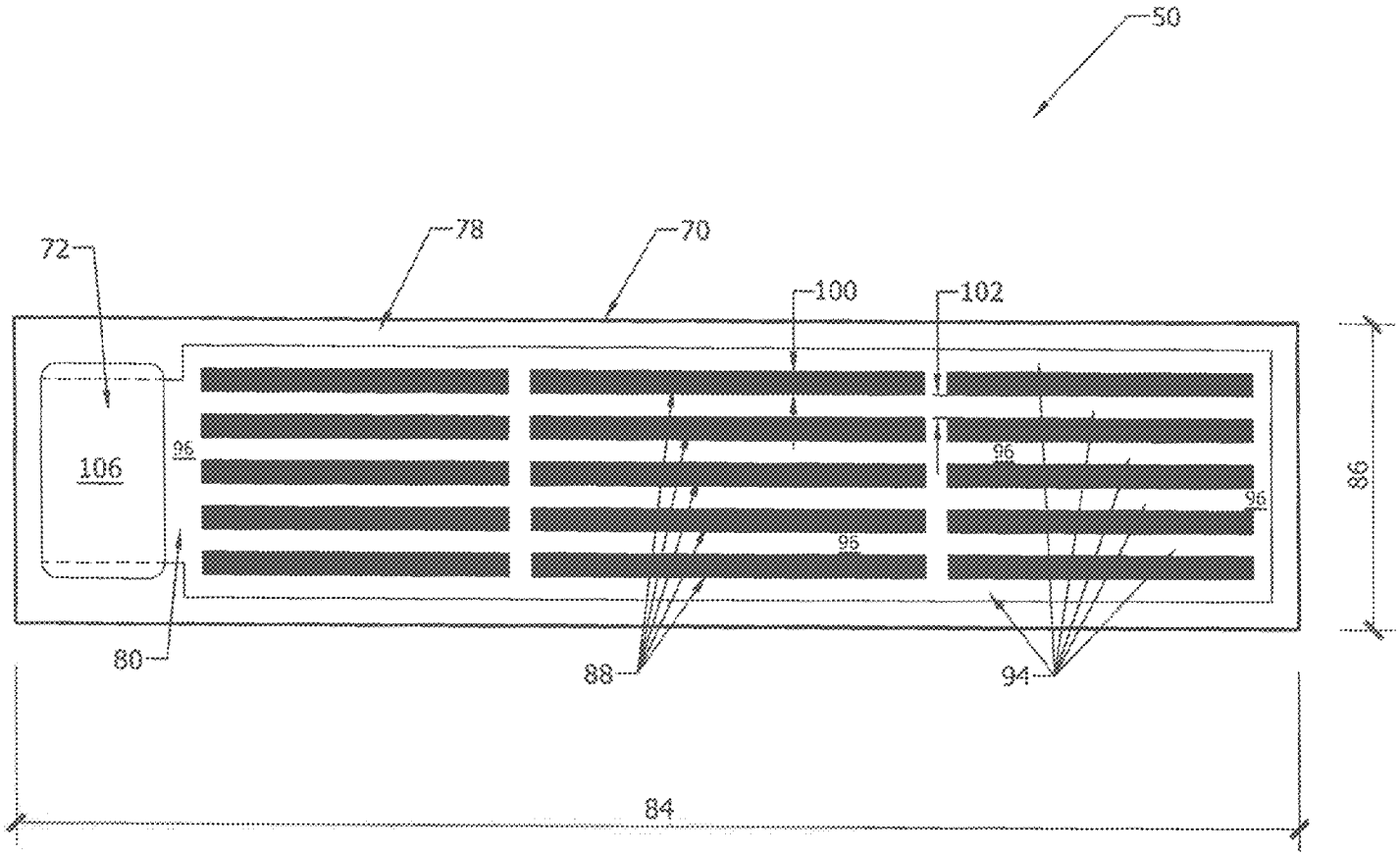
FIG. 5 is a top view of an anti-icing system according to other embodiments of this invention.
Figure 6:
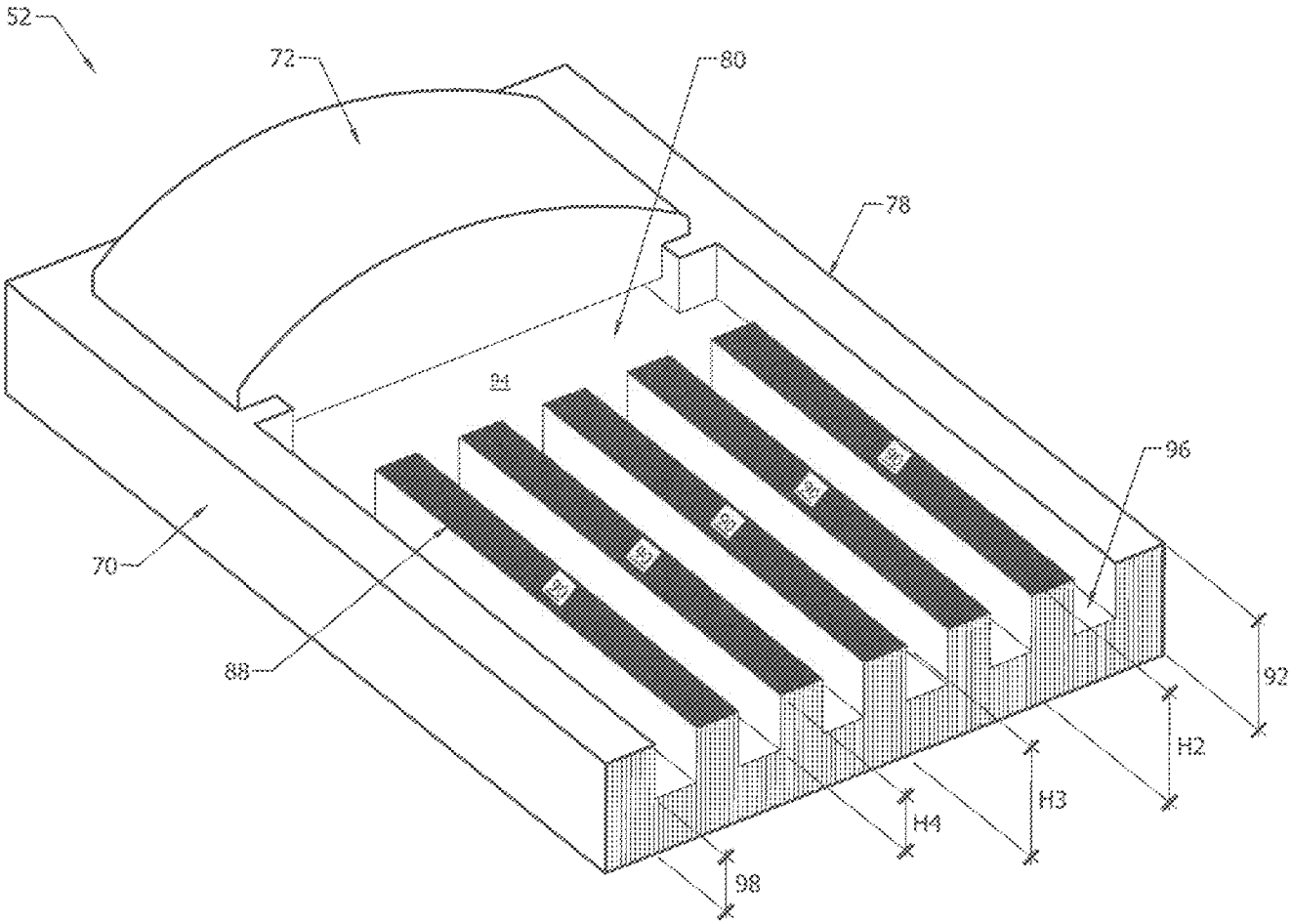
FIG. 6 is a top perspective view of an anti-icing system, shown partially cut away, according to still other embodiments of this invention.
Figure 7:
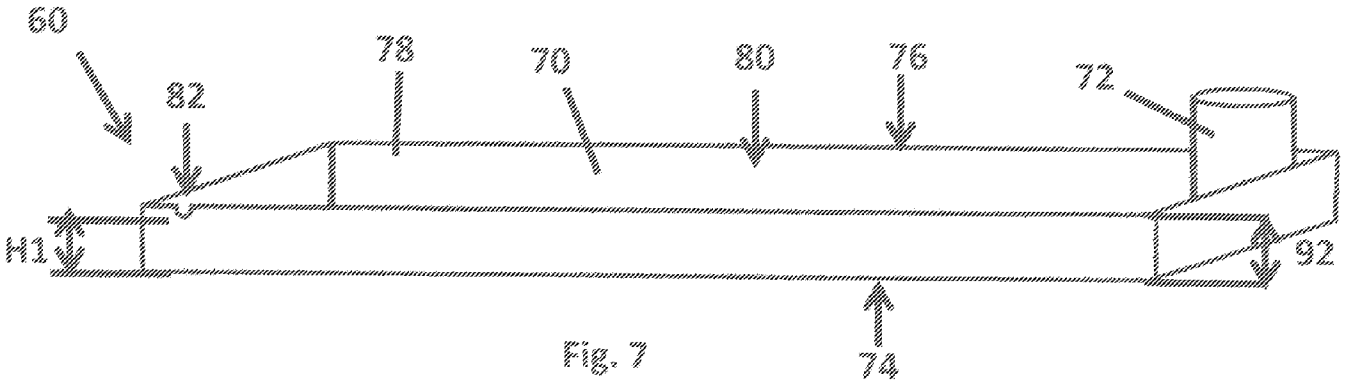
FIG. 7 is a side perspective view of an anti-icing system according to yet other embodiments of this invention.
Figure 10:
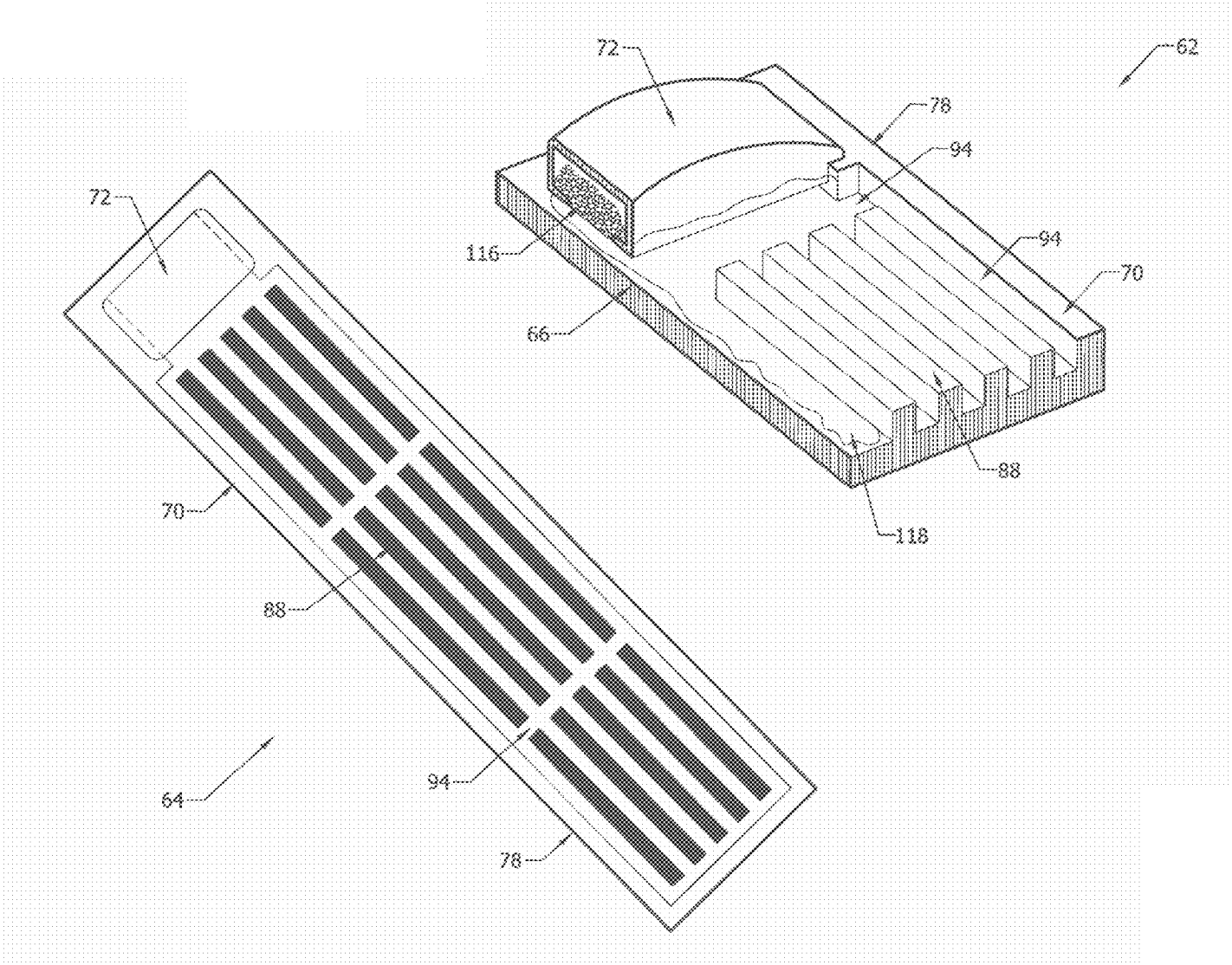
FIG. 10 is a side perspective view of two additional anti-icing systems according to yet other embodiments of this invention, with the upper system shown in partial cutaway.

With continuing reference to FIGS. 4-8 and 10, the top 76 may include an outer wall 78 that forms a perimeter of a pool area 80 and that has an overflow drain 82, shown in FIG. 7, formed on an upper portion of the outer wall 78. FIG. 10 shows a portion of the outer wall removed, at 66 for the anti-icing system 62. The outer wall 78 may have a minimum height H1 with respect to the bottom 74 of the tray defined at the overflow drain 82. While one overflow drain 82 is shown, it should be understood that the number, size and location of the overflow drain(s) can be any chosen with the sound judgment of a person of skill in the art. In one embodiment, the outer wall 78 has the same maximum height 92, labeled in FIGS. 6 and 7, everywhere except at the overflow drain(s) 82. In one embodiment, the outer wall's maximum height is not more than 3 millimeters above the height H1. The size of the pool area 80 can be any chosen with the sound judgment of a person of skill in the art. While the pool area 80 shown has a rectangular shape, it should be understood that it could have any shape that matches the specific walk-on surface 18. In one embodiment, shown, the pool area 80 has a length 84 substantially equal to the length 20 of the step 20 and a width 86 that is substantially equal to the width (tread depth) 26 of the step 20.

Figure 4:
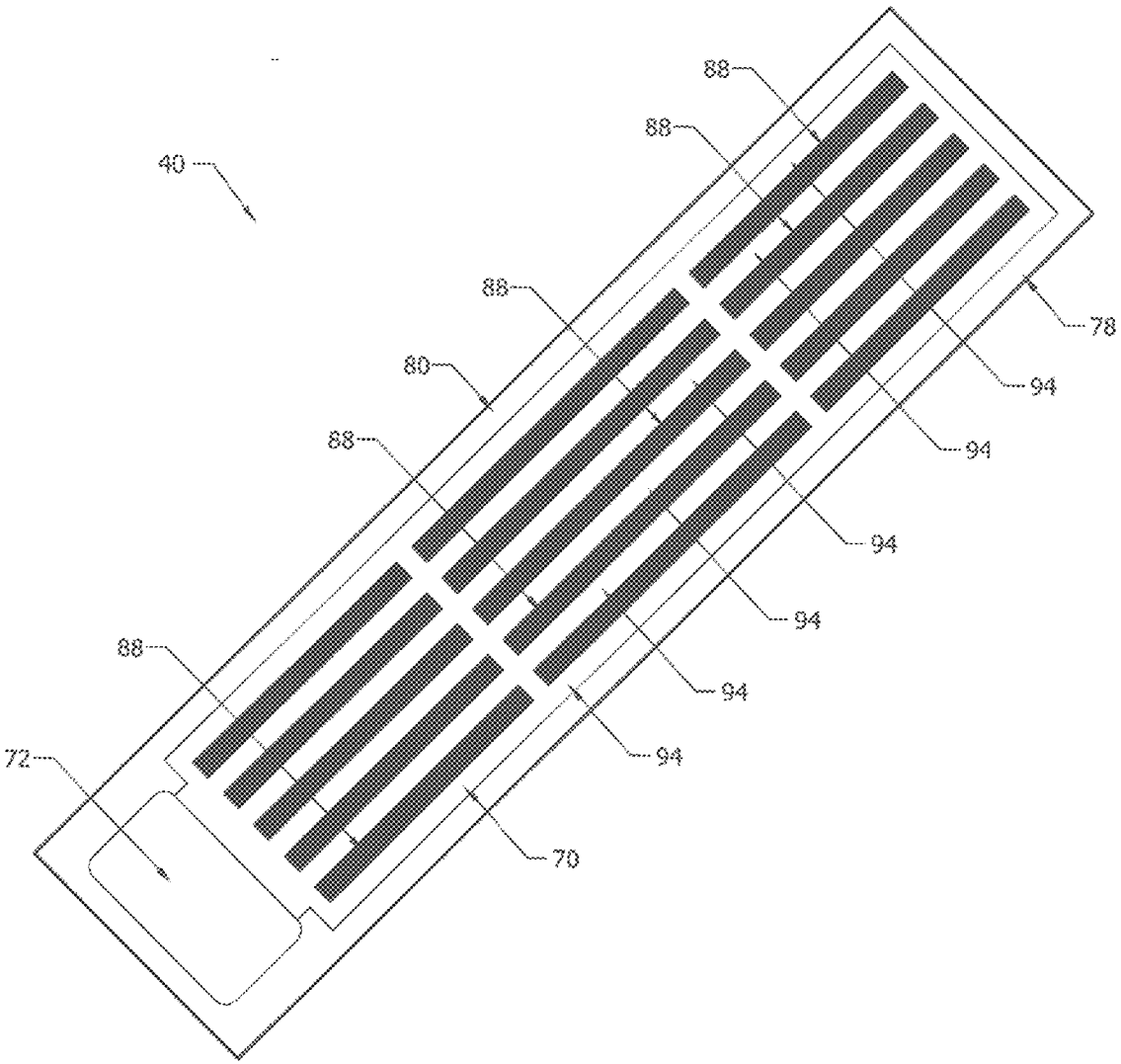
FIG. 4 is a close-up top view of the anti-icing system shown in FIG. 1.
Figure 8:
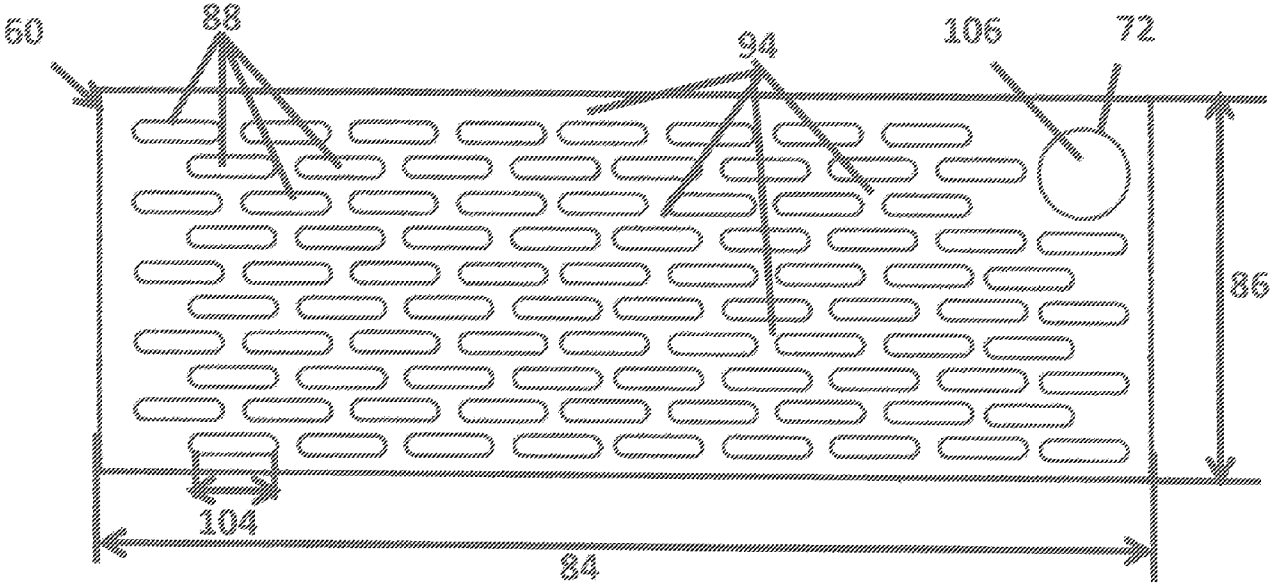
FIG. 8 is a top view of the anti-icing system shown in FIG. 7.

The top 76 may have one or more platforms 88 positioned within the pool area 80, as shown. Each platform 88 may have an upper surface 90, labeled in FIG. 6, defining a pedestrian reception area strong enough to support the weight of the pedestrian 10, via the pedestrian's foot 12, to the walk-on surface 18. Each platform 88 may have a maximum height, referenced consecutively H2, H3, H4, etc., with respect to the bottom 74 of the tray 70 that is less than height H1 for purposes to be discussed below. In one embodiment, the maximum heights H2, H3, H4, etc. of each platform 88 are the same; thus H2=H3=H4, etc. The top 76 may also have one or more channels 94 that separate the platforms 88. The channels 94 may have sides defined by neighboring platforms 88 or by a neighboring outer wall 78, as shown. The channels 94 may have a bottom 96, labeled in FIGS. 5 and 6, that extends below the upper surfaces 90 of the platforms 88. Thus, the channel bottoms 96 have a minimum height 98, labeled in FIG. 6, with respect to the bottom 74 of the tray 70 that is less than the maximum heights of the platforms 88. In one embodiment, shown, the channels 94 communicate with each other. The anti-icing systems 40 and 50, see FIGS. 4 and 5, show an embodiment where platforms 88 extend lengthwise within the pool area 80. Some channels 94 also extend lengthwise within the pool area 80, between the platforms 88 and between the outer wall 78 and the nearest platform 88. The anti-icing systems 40 and 50 also have channels that extend widthwise at the opposite ends of the pool area 80. The anti-icing system 60, see FIG. 8, shows an embodiment where the platforms 88 are not continuous along the length of the pool area 80 but rather are arranged in a mesh pattern with the channels 94. The anti-icing systems 62 and 64, see FIG. 10, also show embodiments where the platforms 88 are not continuous along the length of the pool area.

The number, sizes and shapes of the platforms 88 and channels 94 can be any chosen with the sound judgment of a person of skill in the art. The anti-icing systems 40 and 50 have five platforms 88 and six channels 94 from side to side while anti-icing system 52 has three platforms 88 and four channels 94 from side to side. For the anti-icing systems 40, 50 and 52, the platforms 88 may have a width 100, labeled in FIG. 5, while the channels have a width 102, also labeled in FIG. 5. In one embodiment, the widths 100 of each platform 88 are the same. In another embodiment, they are not the same. Similarly, in one embodiment, the widths 102 of each channel 94 are the same and in another they are not. In yet another embodiment, the widths 100 of the platforms 88 are the same as the widths 102 of the channels 94. The anti-icing systems 62 and 64 also show the use of different platform widths. For the anti-icing system 60, the platforms 88 may have lengths 104 and widths 102. The lengths of the platforms 88 may be limited only by the length of the tray 70. In another embodiment, one or more platforms 88 may be perorated and suspended from the outer wall 78.

It may be preferred that the channels 94 remain small enough to maintain the human's feet 12 on one or more platforms 88 without slipping into a channel 94. It has been discovered that keeping the channel width to 2.0 inches or less has the advantage of keeping relatively shallow sections in close proximity to relatively deeper sections so that the freshly melted snow/ice can quickly commingle with the solution in the pool area 80. The ratio of shallow to deep sections of channels 94 can be designed as desired. In one embodiment, the angle of platform walls can be changed (not just 90 degrees/perpendicular to the walk-on surface 18 as shown). To use more of deeper sections and less shallow sections, for example, the platforms 88 can be made wider at their base and narrower at their top. In another embodiment, the platforms 88 can be made narrower at their base and wider at their top. This design may have the advantage of minimizing potential tripping. This design also has the advantage of maximizing the shallow sections without sacrificing total solution volume. In yet another embodiment, the outer wall 78 can be angled inward and downward to the height of the platform 88 so that the pool area 80 can expand as far to the edge of the outer wall 78 as possible.

As a general rule, it has been discovered that a larger pool area 80 volume provides more protection. A pool area with 3.0 gallons of solution, for example, can melt more frozen precipitation than a pool area with only 1.0 gallon of solution. However, the pool area 80 cannot achieve more volume simply by being deeper. At a certain point (somewhere higher than 0.75 inches) the solution will separate from the freshly melted frozen precipitation and the top of the solution will freeze since the lower level of solution is more dense with the anti-icing agent.

Figure 9:
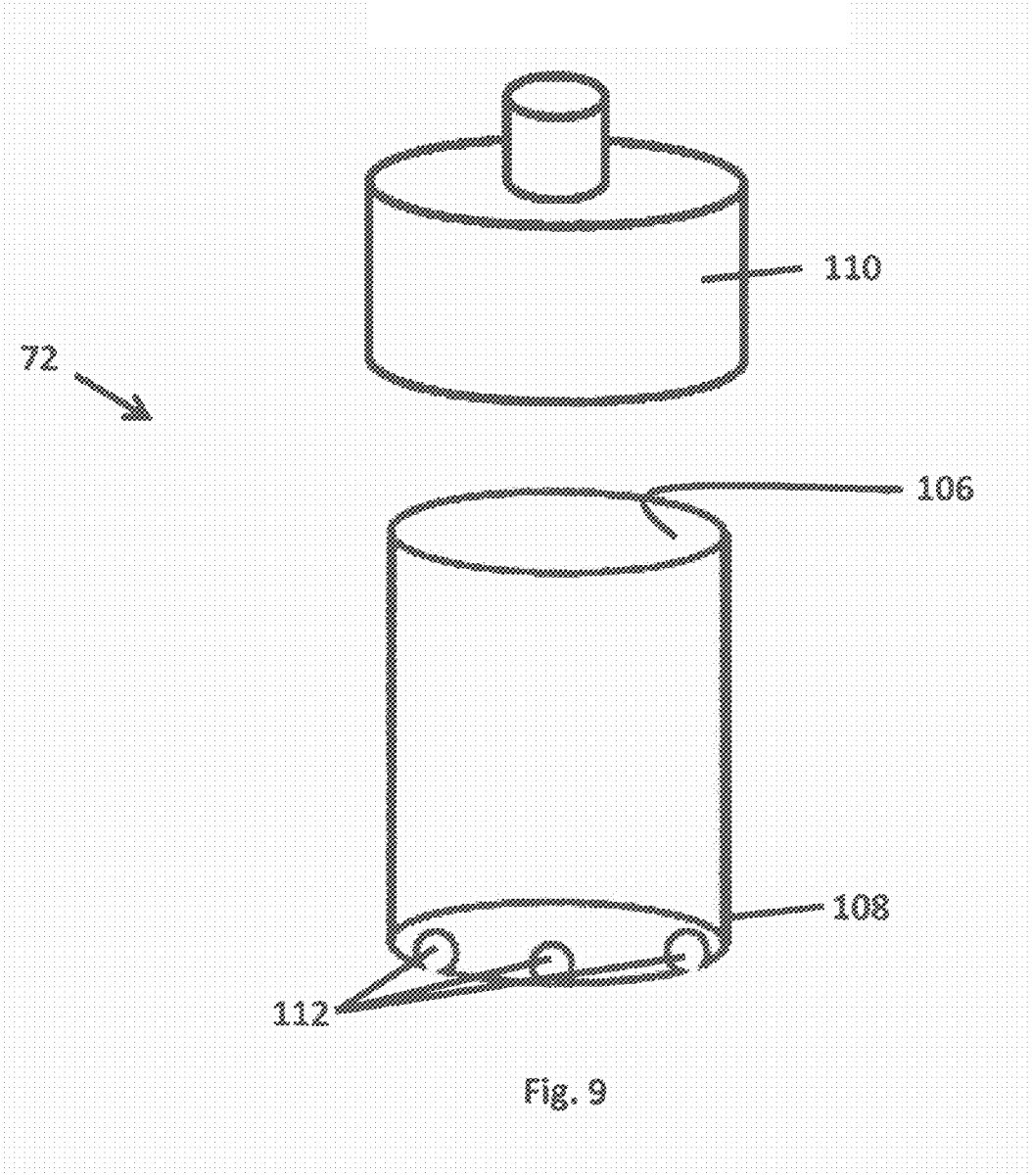
FIG. 9 is a side view of a storage container according to some embodiments of this invention.

With reference now to FIGS. 4-10, the storage containers 72 can have any number, shape and size chosen with the sound judgment of a person of skill in the art. Each storage container 72 may have a cavity 106 that holds an anti-icing agent which will be discussed further below. In another embodiment, the storage container 72 may be a cartridge that can be "snapped on" to the tray and refilled and/or replaced as necessary. The storage containers 72 shown in FIGS. 1, 4 and 7-9 are cylindrically shaped with the longitudinal axis oriented substantially vertically. The storage container 72 shown in FIGS. 5-6, is semi-cylindrically shaped with the longitudinal axis oriented substantially horizontal. The storage containers 72, 72 shown in FIG. 10 have bottom portions, received with the pool areas, that have a length smaller than the length of an upper surface. The storage container 72 may be positioned to communicate the cavity 106 with the pool area 80 so that the anti-icing agent can be transferred from the cavity 106 into the pool area 80. This will be discussed further below. The storage container 72 may have a bottom 108, labeled in FIG. 9, that extends downwardly within the pool area 80, as shown, at least to the maximum height(s) H2, H3, H4, etc. of a platform 88. In another embodiment, the bottom 108 of the storage container 72 extends downwardly within the pool area 80 to the bottom 96 of the channel(s) 94. An anti-icing agent may be positioned within the cavity 106 to have a maximum height that is greater than height H1. This will enable gravity forces to help pull the anti-icing agent into the pool area 80. FIG. 10 shows the storage container 72 used with the anti-icing system 62 in a sectional view where the anti-icing agent 116 is visible. FIG. 9 shows a storage container 72 that has a removable lid 110 that provides access to the cavity 106 so that additional anti-icing agent can be added. The lid 110 may attach to the storage container 72 in any suitable manner, such as a press fit or via thread connection. The container 72 shown in FIG. 9 also has a plurality of release passages 112 that communicate the cavity 106 to the pool area 80 and that control the flow of the associated anti-icing agent as it moves from the cavity 106 into the pool area 80.

With reference now to all the FIGURES, operation of the anti-icing systems 40, 50, 52 and 60 will now be described. The bottom 74 of the tray 70 may be positioned onto the desired walk-on surface 18, with the top 76 substantially facing any source of frozen precipitation. In one embodiment, the bottom 74 may be permanently attached to the walk-on surface 18. The tray 70 may be, for example, installed onto the walk-on surface 18 while the walk-on surface 18 is concrete not yet dried. Other examples include clamping and the use of fasteners. In another embodiment, the tray 70 may simply rest on the walk-on surface 18. In yet another embodiment, structure 114 may be provided that permits the tray 70 to be moved with respect to the walk-on surface 18 between (1) a use condition where the bottom 74 of the tray 70 is positioned on the walk-on surface 18; and, (2) a non-use condition where the bottom 74 of the tray 70 is not positioned on the walk-on surface 18. The storage container 72 may be positioned with respect to the tray 70 so that the cavity 106 communicates with the pool area 80. In one embodiment, this may include inserting the bottom 108 of the storage container 72 within the pool area 80. An anti-icing agent may then be placed within the cavity 106. This may be done as frequently as necessary depending on usage rate. Any anti-icing agent chosen with the sound judgment of a person of skill in the art may be used, including but not limited to salt. If the storage container 72 has a lid 110, the lid 110 may be removed and then anti-icing agent may be added to the cavity 106. The lid 110 can then be replaced.

With the tray 70 and storage container 72 in place, and with an anti-icing agent placed in the cavity 106, there is nothing further for the operator to do (except add additional anti-icing agent if necessary). Frozen precipitation can then freely enter the pool area 80. As it does, the anti-icing agent is drawn out of the storage container 72 and into the pool area 80. Because of the chemical reaction between the anti-icing agent and the frozen precipitation, the frozen precipitation melts (at temperatures lower than it would otherwise melt) and mixes with the anti-icing agent to produce a solution. FIG. 10 illustrates the solution with reference 118. As frozen precipitation continues to enter the pool area 80, the anti-icing agent continues to be drawn out of the storage container 72 and the amount of solution continues to increase. As the amount of solution increases, it fills the pool area 80 until it drains out of the pool area 80 through the overflow drain 82. What should be noted is that because the upper surfaces 90 of the platforms 88 have heights, H2, H3, H4, etc., that are less/lower than the height H1 of the outer wall 78 at the overflow drain 82, the solution will continuously cover the pedestrian reception areas 90 of the platforms 88—no matter how many platforms 88 are used. As a result, a thin layer of solution will be continuously maintained on the pedestrian reception areas 90. This layer of solution has a thickness equal to the difference between height H1 and heights H2, H3, H4, etc. In one embodiment, the difference between height H2 and height H1 is not more than 5 millimeters. In another more specific embodiment, the difference between height H2 and height H1 is about 3 millimeters. Maintaining the layer of solution at these dimensions has proven to provide ideal performance. This prevents the frozen precipitation from remaining frozen on the pedestrian reception areas 90 and thus greatly reduces the slippery surfaces that pedestrians would otherwise encounter when using the walk-on surface 80. One the frozen precipitation has stopped, the tray 70 may be removed from the walk-on surface 18, if desired, or it may remain on the walk-on surface 18.

In yet another embodiment multiple trays 70 may be interconnected. In one specific embodiment, a number of trays 70 may have a cascading arrangement which may be ideal for use with a sloped walk-on surface. Thus, a tray at a higher elevation may drain its solution through its overflow drain and into the pool area of a tray at a lower elevation by gravity. This tray at a lower elevation may drain its solution through its overflow drain and into the pool area of a tray at an even lower elevation, etc. In still another embodiment, when gravity cannot be used or it is undesirable to use it, a pump may be used to move/circulate the solution from one tray to another.

In another embodiment, all or a portion of the pool area may be fitted with an absorbing material such as a sponge or shammy. The absorbing material may provide different characteristics for the solution to prevent solution separation and/or to modify the freezing temperature of the solution.

In still another embodiment, if the tray is narrow enough, a platform may not be necessary as the outer wall 78 may provide sufficient support for the human.

Numerous embodiments have been described, hereinabove. It will be apparent to those skilled in the art that the above methods and apparatuses may incorporate changes and modifications without departing from the general scope of this invention. The components described can be formed of any material(s) chosen with the sound judgment of a person of skill in the art. In one non-limiting example, the platforms and/or outer walls may be formed of rubber. Regardless of the material used, the platforms and/or outer walls may have non-slip upper surfaces. It is intended to include all such modifications and alterations insofar as they come within the scope of the appended claims or the equivalents thereof.

Having thus described the invention, it is now claimed:

1. An anti-icing system for use by an associated typically sized human pedestrian having a weight and a foot with: (1) an associated walk-on surface that is an outdoor step positioned at least 4 inches above a neighboring ground surface and having a length and a tread depth; and, (2) an associated anti-icing agent, the anti-icing system comprising:

a tray comprising: a bottom suitable to be positioned on the associated walk-on surface;

and, a top that faces an associated source of frozen precipitation when the tray is positioned on the associated walk-on surface;

a storage container having a cavity;

wherein the top of the tray comprises: (1) an outer wall that forms a perimeter of a pool area and that has an overflow drain formed on an upper portion of the outer wall; wherein the outer wall has a minimum height H1 with respect to the bottom of the tray defined at the overflow drain; wherein the pool area has a length substantially equal to the length of the outdoor step and a width substantially equal to the tread depth of the outdoor step; (2) a first platform positioned within the pool area and having an upper surface defining a pedestrian reception area capable of supporting the weight of the associated pedestrian via the foot to the associated walk-on surface; wherein the first platform has a maximum height H2 with respect to the bottom of the tray that is less than height H1; (3) a second platform positioned within the pool area and having an upper surface defining a pedestrian reception area capable of supporting the weight of the associated pedestrian via the foot to the associated walk-on surface; wherein the second platform has a maximum height H3 with respect to the bottom of the tray that is less than height H1; and, (4) a first channel that separates the first and second platforms and that has a first side defined by the first platform, a second side defined by the second platform, and a bottom; wherein the bottom of the first channel has a minimum height with respect to the bottom of the tray that is less than height H2;

wherein the storage container is positioned to communicate the cavity with the pool area; and, wherein the anti-icing system operates when the associated anti-icing agent is placed within the cavity and associated frozen precipitation enters the pool area to draw the anti-icing agent out of the storage container and into the pool area to melt the associated frozen precipitation to form a solution that continuously covers the pedestrian reception areas of the first and second platforms and that drains out of the pool area through the overflow drain as the associated frozen precipitation continues to enter the pool area.

2. The anti-icing system of claim 1 wherein when the storage container is positioned to communicate the cavity with the pool area:

the storage container has a bottom that extends downward within the pool area at least to height H2; and, the associated anti-icing agent is positioned within the cavity to have a maximum height that is greater than height H1.

3. The anti-icing system of claim 2 wherein:

height H3 substantially equals height H2; and, the difference between height H2 and height H1 is not more than 5 millimeters.

4. The anti-icing system of claim 3 wherein the tray further comprises:

a third platform positioned within the pool area and having an upper surface defining a pedestrian reception area capable of supporting the weight of the associated pedestrian via the foot to the associated walk-on surface; wherein the third platform has a maximum height H4 with respect to the bottom of the tray that is less than height H1;

wherein the second and third platforms are separated by a second channel having a first side defined by the second platform, a second side defined by the third platform, and a bottom;

wherein the bottom of the second channel has a minimum height with respect to the bottom of the tray that is less than height H2;

wherein the second channel communicates with the first channel;

wherein height H4 substantially equals height H2;

wherein the maximum distance between the first and second sides of the first channel is 2 inches;

wherein the maximum distance between the first and second sides of the second channel is 2 inches; and, wherein the anti-icing system operates when the associated anti-icing agent is placed within the cavity and the associated frozen precipitation enters the pool area to continuously cover the pedestrian reception area of the third platform with the solution.

5. An anti-icing system for use with an associated walk-on surface and an associated anti-icing agent by an associated typically sized human pedestrian having a weight and a foot, the anti-icing system comprising:

a tray comprising: a bottom suitable to be positioned on the associated walk-on surface;

and, a top that faces an associated source of frozen precipitation when the tray is positioned on the associated walk-on surface;

a storage container having a cavity;

wherein the top of the tray comprises: (1) an outer wall that forms a perimeter of a pool area and that has an overflow drain formed on an upper portion of the outer wall; wherein the outer wall has a minimum height H1 with respect to the bottom of the tray defined at the overflow drain; and, (2) a first platform positioned within the pool area and having an upper surface defining a pedestrian reception area capable of supporting the weight of the associated pedestrian via the foot to the associated walk-on surface; wherein the first platform has a maximum height H2 with respect to the bottom of the tray that is less than height H1;

wherein the storage container is positioned to communicate the cavity with the pool area; and, wherein the anti-icing system operates when the associated anti-icing agent is placed within the cavity and associated frozen precipitation enters the pool area to draw the anti-icing agent out of the storage container and into the pool area to melt the associated frozen precipitation to form a solution that continuously covers the pedestrian reception area of the first platform and that drains out of the pool area through the overflow drain as the associated frozen precipitation continues to enter the pool area.

6. The anti-icing system of claim 5 wherein when the storage container is positioned to communicate the cavity with the pool area:

the storage container has a bottom that extends downward within the pool area at least to height H2; and, the associated anti-icing agent is positioned within the cavity to have a maximum height that is greater than height H1.

7. The anti-icing system of claim 5 wherein the tray further comprises:

a second platform positioned within the pool area and having an upper surface defining a pedestrian reception area capable of supporting the weight of the associated pedestrian via the foot to the associated walk-on surface; wherein the second platform has a maximum height H3 with respect to the bottom of the tray that is less than height H1;

wherein the first and second platforms are separated by a first channel having a first side defined by the first platform, a second side defined by the second platform, and a bottom;

wherein the bottom of the first channel has a minimum height with respect to the bottom of the tray that is less than height H2;

wherein height H3 substantially equals height H2; and, wherein the anti-icing system operates when the associated anti-icing agent is placed within the cavity and the associated frozen precipitation enters the pool area to continuously cover the pedestrian reception area of the second platform with the solution.

8. The anti-icing system of claim 7 wherein the tray further comprises:

a third platform positioned within the pool area and having an upper surface defining a pedestrian reception area capable of supporting the weight of the associated pedestrian via the foot to the associated walk-on surface; wherein the third platform has a maximum height H4 with respect to the bottom of the tray that is less than height H1;

wherein the second and third platforms are separated by a second channel having a first side defined by the second platform, a second side defined by the third platform, and a bottom;

wherein the bottom of the second channel has a minimum height with respect to the bottom of the tray that is less than height H2;

wherein the second channel communicates with the first channel;

wherein height H4 substantially equals height H2;

wherein the maximum distance between the first and second sides of the first channel is 2 inches;

wherein the maximum distance between the first and second sides of the second channel is 2 inches; and, wherein the anti-icing system operates when the associated anti-icing agent is placed within the cavity and the associated frozen precipitation enters the pool area to continuously cover the pedestrian reception area of the third platform with the solution.

9. The anti-icing system of claim 5 wherein:

the difference between height H2 and height H1 is not more than 5 millimeters.

10. The anti-icing system of claim 9 wherein:

the difference between height H2 and height H1 is about 3 millimeters.

11. The anti-icing system of claim 5 wherein:

the outer wall has a maximum height that is not more than 3 millimeters above the height H1.

12. The anti-icing system of claim 5 wherein:

the associated walk-on surface is formed on an associated step having a length and a tread depth; and, the pool area has a length substantially equal to the length of the associated step and a width substantially equal to the tread depth of the associated step.

13. The anti-icing system of claim 5 wherein the storage container comprises:

a removable lid that provides access to the cavity;

a plurality of release passages that communicate the cavity to the pool area and that control the flow of the associated anti-icing agent from the cavity into the pool area.

14. A method for de-icing a walk-on surface by an associated typically sized human pedestrian having a weight and a foot, the method comprising the steps of:

(A) providing an anti-icing system comprising: a tray comprising: (1) a bottom; and, a top; and, (2) a storage container having a cavity;

(B) providing the top of the tray with: (1) an outer wall that forms a perimeter of a pool area and that has an overflow drain formed on an upper portion of the outer wall; wherein the outer wall has a minimum height H1 with respect to the bottom of the tray defined at the overflow drain; and, (2) a first platform positioned within the pool area and having an upper surface defining a pedestrian reception area capable of supporting the weight of the associated pedestrian via the foot to the associated walk-on surface; wherein the first platform has a maximum height H2 with respect to the bottom of the tray that is less than height H1;

(C) positioning the bottom of the tray onto the associated walk-on surface with the top facing an associated source of frozen precipitation;

(D) positioning the storage container with respect to the tray so that the cavity communicates with the pool area;

(E) placing an anti-icing agent within the cavity;

(F) allowing frozen precipitation to enter the pool area;

(G) drawing the anti-icing agent out of the storage container and into the pool area to melt the frozen precipitation to form a solution that continuously covers the pedestrian reception area of the first platform; and, (H) draining excess amounts of the solution out of the pool area through the overflow drain as the associated frozen precipitation continues to enter the pool area.

15. The method of claim 14 wherein:

step (B) comprises the steps of providing the top of the tray with (1) a second platform positioned within the pool area and having an upper surface defining a pedestrian reception area capable of supporting the weight of the associated pedestrian via the foot to the associated walk-on surface; wherein the second platform has a maximum height H3 with respect to the bottom of the tray that is less than height H1; wherein height H3 substantially equals height H2; and, (2) a first channel that separates the first and second platforms and that has a first side defined by the first platform, a second side defined by the second platform, and a bottom; wherein the bottom of the first channel has a minimum height with respect to the bottom of the tray that is less than height H2; and, step (G) comprises the step of: continuously covering the pedestrian reception area of the second platform with the solution.

16. The method of claim 15 wherein:

step (B) comprises the steps of providing the top of the tray with (1) a third platform positioned within the pool area and having an upper surface defining a pedestrian reception area capable of supporting the weight of the associated pedestrian via the foot to the associated walk-on surface; wherein the third platform has a maximum height H4 with respect to the bottom of the tray that is less than height H1; wherein height H4 substantially equals height H2; and, (2) a second channel that separates the second and third platforms and that has a first side defined by the second platform, a second side defined by the third platform, and a bottom; wherein the bottom of the second channel has a minimum height with respect to the bottom of the tray that is less than height H2; and, step (G) comprises the step of: continuously covering the pedestrian reception area of the third platform with the solution.

17. The method of claim 14 wherein:

step (A) comprises the step of: providing the storage container with a lid; and, step (E) comprises the steps of: (1) removing the lid from the storage container; (2) placing the anti-icing agent within the cavity; and, (3) replacing the lid onto the storage container.

18. The method of claim 14 wherein:

step (C) comprises the step of: permanently attaching the bottom of the tray to the associated walk-on surface.

19. The method of claim 14 wherein:

step (B) comprises the step of: providing the tray with structure that permits the tray to be moved with respect to the walk-on surface between (1) a use condition where the bottom of the tray is positioned on the walk-on surface; and, (2) a non-use condition where the bottom of the tray is not positioned on the walk-on surface;

step (C) comprises the step of: using the structure to move the tray into the use condition; and, after step (H) the method comprises the step of: using the structure to move the tray into the non-use condition.

20. The method of claim 14 wherein:

the associated walk-on surface is an outdoor step having a length and a tread depth; and, step (B) comprises the step of: providing the pool area to have a length substantially equal to the length of the outdoor step and a width substantially equal to the tread depth of the outdoor step.

* * * * *